United States Patent [19]

Saito et al.

[11] 4,093,454

[45] June 6, 1978

[54] NICKEL-BASE SINTERED ALLOY

[75] Inventors: Yuichi Saito; Osamu Mayama, both of Niigata, Japan

[73] Assignee: Mitsubishi Kinzoku Kabushiki Kaisha, Tokyo, Japan

[21] Appl. No.: 744,932

[22] Filed: Nov. 24, 1976

[30] Foreign Application Priority Data

Dec. 18, 1975 Japan ..... 50-150123

[51] Int. Cl.[2] ..... B22F 1/00

[52] U.S. Cl. ..... 75/236; 75/211; 75/246; 75/950; 75/171

[58] Field of Search ..... 75/211, 171, 950, 246, 75/236; 29/182, 182.5

[56] References Cited

U.S. PATENT DOCUMENTS

| | | | |
|---|---|---|---|
| 2,853,767 | 9/1958 | Burkhammer | 75/211 |
| 3,096,174 | 7/1963 | Helin | 75/211 |
| 3,194,468 | 7/1965 | Naeser et al. | 75/211 |
| 3,326,676 | 6/1967 | Rubel | 75/211 |
| 3,510,292 | 5/1970 | Hardy et al. | 75/211 |
| 3,578,443 | 5/1971 | Grant et al. | 75/211 |

OTHER PUBLICATIONS

Metal Progress Data Book, 6–77, pp. 120–121, 116, 117.

*Primary Examiner*—Brooks H. Hunt
*Attorney, Agent, or Firm*—Flynn & Frishauf

[57] ABSTRACT

A nickel-base sintered alloy which comprises: being manufactured from a reduced powder by the conventional powder metallurgy process with said reduced powder as a material powder, said reduced powder being prepared by simultaneously reducing a mixed powder consisting of powders of oxides of elements constituting said sintered alloy with a carbon powder added and mixed therein, and said reduced powder consisting of powders of said constituent elements and powders of carbides thereof; and consisting essentially of, in weight percentage:

| | | | | |
|---|---|---|---|---|
| chromium | from | 10.0 | to | 35.0 % |
| tungsten | from | 0.5 | to | 15.0 % |
| cobalt | from | 0.2 | to | 12.0 % |
| molybdenum | from | 0.1 | to | 20.0 % |
| iron | from | 0.1 | to | 20.0 % |
| titanium | from | 0.05 | to | 2.00 % |
| silicin | from | 0.05 | to | 1.50 % |
| manganese | from | 0.05 | to | 1.00 % |
| carbon | from | 0.1 | to | 3.5 % |

and the balance nickel and incidental impurities.

The above-mentioned nickel-base sintered alloy, also containing, in weight percentage, from 0.05 to 1.00% boron and from 0.1 to 2.0% aluminum.

These nickel-base sintered alloys provide a relatively wide range of sintering temperatures applicable in the manufacture thereof, and have furthermore a high sintered density of at least 95% of the theoretical value and are excellent in machinability, heat resistance, wear resistance and corrosion resistance.

4 Claims, 3 Drawing Figures

NICKEL-BASE SINTERED ALLOY

FIELD OF THE INVENTION

The present invention relates to a nickel-base alloy which provides a relatively wide range of sintering temperatures applicable in the manufacture thereof, and has furthermore a high sintered density of at least 95% of the theoretical value and is excellent in machinability, the heat resistance, the wear resistance and corrosion resistance.

BACKGROUND OF THE INVENTION

Nickel-base cast alloys containing such elements as chromium, tungsten, cobalt, molybdenum, iron, titanium, silicon, manganese and carbon have generally heat resistance, wear resistance and corrosion resistance superior to those of high-alloy steels, and are therefore popularly in practical use as materials for structural members serving under serious conditions.

In the above mentioned conventional nickel-base cast alloys, however, crystal grains of nickel forming the base grow into coarse dendrites at the time of casting, solidification and cooling thereof. It is also inevitable at the same time that chromium, tungsten and other constituent elements react with carbon, another constituent element, to form carbides which also grow into coarse grains. In addition, as compared with high-alloy steels, the conventional nickel-base cast alloys are far inferior in plastic formability in hot and cold. It is therefore very difficult to refine the above-mentioned base crystal grains and carbide grains thus becoming coarse by forging the alloys.

Because of the aforementioned coarse base crystal grains and carbide grains, in putting the conventional nickel-base cast alloys to practical use, local stress concentration occurring in said coarsening portions often causes breakout of the cast alloys, and moreover, segregation of the constituent elements causes such problems as a decrease in the corrosion resistance of teh cast alloys. It is also very difficult to machine the conventional nickel-base cast alloys into structural members of desired shape and dimensions at a high accuracy because of the very low machinability of such alloys.

With a view to solving the above-mentioned problems inherent to the conventional nickel-base cast alloys, there is proposed the manufacture of nickel-base sintered alloys having substantially the same chemical composition as the nickel-base cast alloys by the powder metallurgy process. The above-mentioned sintered alloys are industrially manufactured in general by the powder metallurgy process, which comprises preparing an alloy powder serving as material powder from a molten alloy containing necessary constituents by the water-atomizing process or the gas-atomizing process; forming a green compact of desired shape and dimensions by pressing said alloy powder after thoroughly pulverizing and mixing said alloy powder; and sintering thus formed green compact with or without a pressure in a reducing, neutral or vacuum atmosphere.

However, the nickel-base sintered alloys manufactured by the above-mentioned conventional powder metallurgy process still have the following drawbacks:

(1) Since the alloy powder serving as the material powder is usually prepared by the water-atomizing or gas-atomizing process, said alloy powder has not only a spherical shape but also a relatively large particle size, this leading to a low compression-formability. What is worse, in sintering, particle surfaces of said alloy powder are not mutually diffused even by heating said alloy powder to a temperature closest to the melting point thereof in a reducing, neutral or vacuum atmosphere. It is therefore difficult to impart to thus manufactured sintered alloy such properties required as a high sintered density and excellent heat resistance, wear resistance and corrosion resistance.

(2) By raising the sintering temperature to a temperature immediately below the melting point of said alloy powder in sintering, it is possible to cause mutual diffusion of particle surfaces of said alloy powder. If the sintering temperature is a little higher than this level, however, said alloy powder is melted down. Thus, the too tight range of sintering temperatures for said alloy powder makes it difficult to apply an effective control over the sintering temperature and hence to go into mass production of a sintered alloy.

(3) As described above, said alloy powder has not only a spherical shape but also a relatively large particle size. Therefore, even if a sintered alloy is manufactured, out of economic considerations, at a sintering temperature within the tight range as mentioned above, it is difficult to impart a sintered density of at least 95% of the theoretical value to the manufactured sintered alloy. In a sintered alloy having sintered density less than 95% of the theoretical value, even with base crystal grains and percipitated carbide grains having a fine and uniform grain size, the toughness decreases under the effect of remaining pores in the sintered alloy, and the heat resistance, impact resistance, the fatigue strength and corrosion resistance, which are properties necessary in actual service, are also decreased.

SUMMARY OF THE INVENTION

A principal object of the present invention is therefore to provide a nickel-base sintered alloy which has a relatively wide range of diffusion sintering temperatures applicable at the time of manufacture thereof and a sintered density of at least 95% of the theoretical value.

Another object of the present invention is to provide a nickel-base sintered alloy excellent in machinability, the heat resistance, the wear resistance, wear resistance and corrosion resistance.

In accordance with one of the features of the present invention, there is provided a nickel-base sintered alloy which comprises:

being manufactured from a reduced powder by the conventional powder metallurgy process with said reduced powder as a material powder, said reduced powder being prepared by simultaneously reducing a mixed powder consisting of powders of oxides of elements constituting said sintered alloy with a carbon powder added and mixed therein, and said reduced powder consisting of powders of said constituent elements and powders of carbides thereof; and consisting essentially of, in weight percentage:

| | | | | |
|---|---|---|---|---|
| chromium | from | 10.0 | to | 35.0 % |
| tungsten | from | 0.5 | to | 15.0 % |
| cobalt | from | 0.2 | to | 12.0 % |
| molybdenum | from | 0.1 | to | 20.0 % |
| iron | from | 0.1 | to | 20.0 % |

-continued

| | | | | |
|---|---|---|---|---|
| titanium | from | 0.05 | to | 2.00 % |
| silicon | from | 0.05 | to | 1.50 % |
| manganese | from | 0.05 | to | 1.00 % |
| carbon | from | 0.1 | to | 3.5 % |

and the balance nickel and incidental impurities.

The above-mentioned nickel-base sintered alloy includes a nickel-base sintered alloy also containing, in weight percentage, from 0.05 to 1.00% boron and from 0.1 to 2.0% aluminum.

BRIEF DESCRIPTION OF THE DRAWINGS

The present invention is illustrated by way of examples in the accompanying drawings which form part of this application and in which.

DETAILED DESCRIPTION OF PREFERRED EMBODIMENTS

Figure 1:
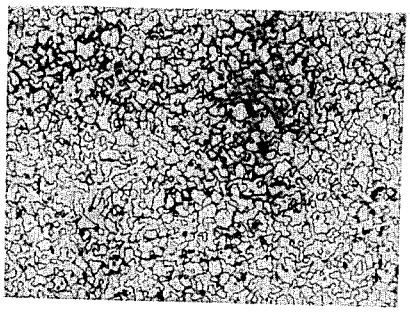
FIG. 1 is a microphotograph (× 400) showing the structure of a nickel-base sintered alloy of the present invention.

In view of the foregoing, we have made intensive studies to obtain a nickel-base sintered alloy which has a relatively wide range of diffusion sintering temperatures applicable in the manufacture thereof and a high sintered density of at least 95% of the theoretical value, and which is excellent in the machinability, heat resistance, the wear resistance and corrosion resistance. As a result, it has been proven that a nickel-base sintered alloy provided with all the properties mentioned above is obtained by manufacturing said nickel-base sintered alloy from a reduced powder by the conventional powder metallurgy process with said reduced powder as a material powder, said reduced powder being prepared by simultaneously reducing a mixed powder consisting of powders of oxides of elements constituting said sintered alloy with a carbon powder added and mixed therein, and said reduced powder consisting of powders of said constituent elements and powders of carbides thereof; and by causing said nickel-base sintered alloy to have a chemical composition consisting essentially of, in weight percentage:

| | | | | |
|---|---|---|---|---|
| chromium | from | 10.0 | to | 35.0 % |
| tungsten | from | 0.5 | to | 15.0 % |
| cobalt | from | 0.2 | to | 12.0 % |
| molybdenum | from | 0.1 | to | 20.0 % |
| iron | from | 0.1 | to | 20.0 % |
| titanium | from | 0.05 | to | 2.00 % |
| silicon | from | 0.05 | to | 1.50 % |
| manganese | from | 0.05 | to | 1.00 % |
| carbon | from | 0.1 | to | 3.5 % |

and the balance nickel and incidental impurities, and also that the sintered density of said nickel-base sintered alloy can further be improved by adding to said nickel-base sintered alloy, in weight percentage, from 0.05 to 1.00% boron and from 0.1 to 2.0% aluminum.

As described above, the reduced powder serving as a material powder used in manufacturing the nickel-base sintered alloy of the present invention is prepared by reducing simultaneously a mixed powder consisting of powders of oxides of elements constituting said sintered alloy with a carbon powder added and mixed therein.

From the microscopic point of view, said reduced powder is a secondary powder formed by a slight mutual agglomeration between particles of powders of said constituent elements and powders of carbides thereof, which are primary powder. In this state, particle surfaces of powders of said constituents and powders of carbides thereof are not as yet sufficiently mutually diffused, that is, said reduced powder which is the secondary powder is not as yet completely alloyed. Said reduced powder has therefore a sponge-like structure comprising groups of the primary powder and presents complicated and irregular shapes. This results in a very high compression-formability of said reduced powder, in spite of the very fine particle size thereof, permitting easy forming by the die-forming process. Furthermore, this very fine particle size enables the manufacture of a sintered alloy having a high sintered density.

Now, the reasons why the chemical composition of the nickel-base sintered alloy of the present invention is limited as mentioned above are described below.

(1) CHROMIUM AND TUNGSTEN

Chromium and tungsten have the effect of improving the hardness and the wear resistance of an alloy through the precipitation in the form of carbides in the base nickel crystal grains and along the grain boundaries thereof by the reaction with carbon simultaneously added and contained. In addition, chromium has the effect of remarkably improving the oxidation resistance of the alloy at high temperatures through the formation of a double oxide ($NiO.Cr_2O_3$) of the spinel structure caused by the dissolution of part of chromium in the base nickel.

However, because the desired effects as described above cannot be expected with a chromium content of under 10.0 wt.% and a tungsten content of under 0.5 wt.%, it is necessary for the alloy to contain at least 10.0 wt.% chromium and at least 0.5 wt.% tungsten. With a chromium content of over 35.0 wt.% and a tungsten content of over 15.0 wt.%, on the other hand, the amount of formed carbides of these elements becomes too large, thus causing not only a serious decrease in the thoughness of the alloy but also an extreme deterioration of the machinability thereof. The resulting alloy is not practically serviceable. The alloy should not therefore contain chromium over 35.0 wt.% nor tungsten over 15.0 wt.%.

(2) COBALT AND IRON

Cobalt and iron have the effect of improving the strength of an alloy through the dissolution of cobalt and iron in the base nickel.

However, because the desired effects as described above cannot be expected with a cobalt content of under 0.2 wt.% and an iron content of under 0.1 wt.%, it is necessary for the alloy to contain at least 0.2 wt.% cobalt and at least 0.1 wt.% iron. With a cobalt content of over 12.0 wt.% and an iron content of over 20.0 wt.%, on the other hand, the strength of the alloy decreases again. The alloy should not therefore contain cobalt over 12.0 wt.% nor iron over 20.0 wt.%.

(3) MOLYBDENUM

Molybdenum has the effect of improving the wear resistance of an alloy through the formation of $M_2C$-type or $M_6C$-type carbides by reaction with carbon simultaneously added and contained, and also of improving the strength of an alloy through the dissolution of part of molybdenum in the base nickel.

However, because the desired effect as described above cannot be expected with a molybdenum content of under 0.1 wt.%, the alloy should contain at least 0.1 wt.% molybdenum. With a molybdenum content of over 20.0 wt.%, on the other hand, the amount of formed carbides of molybdenum becomes excessive large, thus causing a serious decrease in the toughness of the alloy. The alloy should not therefore contain molybdenum over 20.0 wt.%.

(4) TITANIUM

Titanium has the effect of improving the strength of an alloy with a slight amount, and also of stabilizing the precipitation phase of an intermetallic compound of nickel and aluminium ($Ni_3Al$) formed in a low-carbon region.

However, because the desired effect as described above cannot be expected with a titanium content of under 0.05 wt.%, the alloy should contain at least 0.05 wt.% titanium. With a titanium content of over 2.00 wt.%, on the other hand, it becomes necessary to raise the reducing temperature in preparing the reduced powder serving as a material powder, thus causing various inconveniences. The alloy should not therefore contain titanium over 2.00 wt.%.

(5) SILICON AND MAGANESE

Silicon and manganese have the effect of improving the strength of an alloy.

However, because the desired effect as described above cannot be expected with silicon and manganese contents of under 0.05 wt.%, respectively, it is necessary for the alloy to contain at least 0.05 wt.% silicon and manganese, respectively. With a silicon content of over 1.50 wt.% and a manganese content of over 1.00 wt.%, respectively, the toughness of the alloy tends to decrease. The alloy should not therefore contain silicon over 1.50 wt.% nor manganese over 1.00 wt.%.

(6) CARBON

Carbon has the effect of improving heat resistance, the high-temperature strength and wear resistance of an alloy through the formation of $M_6C$-type, $M_7C_3$-type, $M_{23}C_6$-type, $M_2C$-type and MC-type carbides by the reaction with such constituents as chromium, tungsten, molybdenum and titanium simultaneously added and contained.

However, because the desired effect as described above cannot be expected with a carbon content of under 0.1 wt.% leading to an insufficient amount of precipitated carbides as mentioned above, it is necessary for the alloy to contain at least 0.1 wt.% carbon. With a carbon content of over 3.5 wt.%, on the other hand, the above-mentioned chromium, tungsten and molybdenum are almost totally consumed to form carbides, thus resulting a the shortage of the portion to dissolve in the base nickel. The alloy should not therefore contain carbon over 3.5 wt.%.

(7) BORON AND ALUMINUM

Boron and aluminum have the effect of removing oxide films formed on the particle surfaces of the primary and/or the secondary powder of the above described reduced powder, and thus facilitating, in sintering, mutual surface diffusion between the primary powder particles and between the secondary powder particles.

However, because the desired effect as described above cannot be expected with a boron content of under 0.05 wt.% and an aluminum content of under 0.1 wt.%, it is necessary for the alloy to contain at least 0.05 wt.% boron and at least 0.1 wt.% aluminum, respectively. With a boron content of over 1.00 wt.% and an aluminum content of over 2.0 wt.%, respectively, on the other hand, the reaction of excessive boron and aluminum with the other constituents tends to reduce the toughness of the alloy. The alloy should not therefore contain boron over 1.00 wt.% nor aluminum over 2.0 wt.%.

Now, the nickle-base sintered alloys of the present invention are described more in detail by way of examples while comparing them with a nickel-base melting-cast alloy outside the scope of the present invention, having substantially the same chemical composition as those of the present invention.

EXAMPLE 1

A mixed powder consisting of 696 g of nickel oxide (II) (NiO) powder, 278 g of chromium oxide (III) ($Cr_2O_3$) powder, 189 g of tungsten oxide (VI) ($WO_3$) powder, 127 g of cobalt oxide (II) CoO) powder, 8 g of molybdenum oxide (VI) ($MoO_3$) powder, 10 g of iron oxide (III) ($Fe_2O_3$) powder, 7 g of titanium oxide (IV) ($TiO_2$) powder, 10.7 g of silicon dioxide ($SiO_2$) powder, 6.5 g of maganese oxide (IV) ($MnO_2$) powder, and 220 g of carbon (C) powder, having a particle size of up to 100 mesh, respectively, was pulverized by a ball mill for 24 hours to prepare a fine mixed powder having an average particle size of 1.5$\mu$m.

Then, said fine mixed powder was reduced by heating to 1,150° C and holding at this temperature for 2 hours in a gaseous hydrogen flow of a dew point of −40° C to obtain a reduced sponge-like mass consisting essentially of, in weight percentage:

| | |
|---|---|
| chromium | 19.0 % |
| tungsten | 15.0 % |
| cobalt | 10.0 % |
| molybdenum | 0.5 % |
| iron | 1.5 % |
| titanium | 0.4 % |
| silicon | 0.5 % |
| manganese | 0.5 % |
| carbon | 0.4 % |

and the balance nickel and incidental impurities.

Said reduced sponge-like mass could easily be pulverized by a hammer mill to a size of up to 100 mesh. The reduced powder thus obtained had a sponge-like structure and an irregular exterior shape, and showed substantially the same chemical composition as said reduced sponge-like mass.

Then, with said reduced powder as the material powder, a green compact was formed from said reduced powder under a pressure of 6 tons/cm$^2$.

This was followed by the sintering of said green compact at a temperature of 1,280° C for 1 hour under vacuum, to manufacture a nickle-base sintered alloy of the present invention (hereinafter called "the First Alloy" of the present invention).

The First Alloy of the present invention thus manufactured had substantially the same chemical composition as that of said reduced powder serving as the material powder, and had the properties as shown in the column of the First Alloy in Table 1 and the structure as shown in the microphotograph (× 400) of FIG. 1.

EXAMPLE 2

A reduced powder serving as the material powder was prepared by adding and mixing to the reduced powder in Example 1, 5g of iron-boron alloy powder and 16 g of nickel-aluminum alloy powder, having a particle size of up to 325 mesh, respectively, thus prepared the reduced powder serving as the material powder which essentially consists of, in weight percentage:

| | |
|---|---|
| chromium | 19.0 % |
| tungsten | 15.0 % |
| cobalt | 10.0 % |
| molybdenum | 0.5 % |
| iron | 1.5 % |
| titanium | 0.4 % |
| silicon | 0.5 % |
| manganese | 0.5 % |
| carbon | 0.4 % |
| boron | 0.1 % |
| aluminum | 0.8 % |

and the balance nickel and incidental impurities.

Then, with the reduced powder thus prepared as the material powder, another nickel-base sintered alloy of the present invention (hereinafter called "the Second Alloy" of the present invention) was manufactured from said reduced powder by the same method and under the same conditions as in Example 1.

Figure 2:
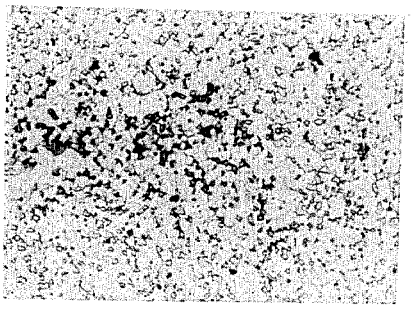
FIG. 2 is a microphotograph (× 400) showing the structure of another nickel-base sintered alloy of the present invention.

The Second Alloy of the present invention thus manufactured had substantially the same chemical composition as that of said reduced powder serving as the material powder, and had the properties as shown in the column of the Second Alloy in Table 1 and the structure as shown in the microphotograph (× 400) of FIG. 2.

For comparison purposes, furthermore, an alloy having substantially the same chemical composition as the First Alloy of the present invention was manufactured by the melting-casting process, to investigate properties and a microphotograph (× 400) thereof. The results are shown in the lowermost line of Table 1 and FIG. 3.

Table 1

| Properties / Kind of alloy | Density ($g/cm^3$) | Density ratio (%) | Tensile strength ($kg/mm^2$) | Hardness ($H_RC$) |
|---|---|---|---|---|
| The First Alloy of the present invention | 8.85 | 97.2 | 83.0 | 30.9 |
| The Second Alloy of the present invention | 9.00 | 99.0 | 86.5 | 32.5 |
| Melting-cast alloy for comparison | 9.10 | 100 | 82.4 | 30.2 |

As is evident from Table 1 and FIGS. 1 to 3, as compared with the nickel-base melting-cast alloy outside the scope of the present invention (hereinafter called the "Reference Alloy") having substantially the same chemical composition as the First Alloy of the present invention, the latter shows almost equal values in terms of the tensile strength and the hardness, although the density and the density ratio are slightly lower than in the former.

Also in Table 1, as is clear from the comparison of the First and the Second Alloys of the present invention, the Second Alloy shows the effect of addition of boron and aluminum. The Second Alloy containing boron and aluminum is superior to the First Alloy in terms of all the properties compared.

Figure 3:
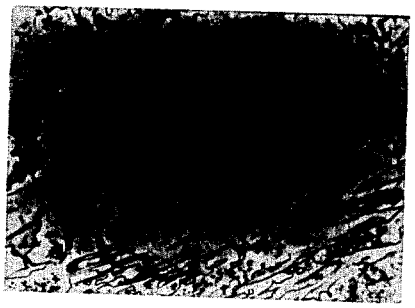
FIG. 3 is a microphotograph (× 400) showing the structure of a nickel-base cast alloy for comparison outside the scope of the present invention.

As shown in FIGS. 1 to 3, furthermore, the First and the Second Alloys of the present invention have a very fine and uniform structure as compared with the Reference Alloy.

According to the present invention, as described above in detail, a nickle-base sintered alloy can be obtained, which, as compared with the nickel-base cast alloy having substantially the same chemical composition as the nickel-base sintered alloy of the present invention and with the conventional nickel-base sintered alloy manufactured from an alloy powder serving as a material powder prepared by the water-atomizing process or the gasatomizing process, has a superior machinability, and hence gives a higher accuracy in fabricating parts therefrom, and moreover, is more suitable as a material for structural members required to be excellent in heat resistance, the wear resistance and corrosion resistance, thus providing industrially useful effects.

WHAT IS CLAIMED IS:

1. A nickel-base sintered alloy having a density of at least 95 percent of the theoretical density thereof, and consisting essentially of, in weight percentage:

| | | | | |
|---|---|---|---|---|
| chromium | from | 10.0 | to | 35.0 % |
| tungsten | from | 0.5 | to | 15.0 % |
| cobalt | from | 0.2 | to | 12.0 % |
| molybdenum | from | 0.1 | to | 20.0 % |
| iron | from | 0.1 | to | 20.0 % |
| titanium | from | 0.05 | to | 2.00 % |
| silicon | from | 0.05 | to | 1.50 % |
| manganese | from | 0.05 | to | 1.00 % |
| carbon | from | 0.1 | to | 3.5 % |

and the balance nickel and incidental impurities: said nickel-base sintered alloy being prepared by sintering a reduced powder mixture consisting of said metals and carbides of said metals, said reduced powder mixture being prepared by the steps comprising simultaneously reducing a mixed powder consisting essentially of powders of oxides of elements constituting said sintered alloy and carbon powder to produce a reduced sponge-like mass, and pulverizing said reduced sponge-like mass to obtain said reduced powder mixture; said alloy and said reduced powder mixture having substantially the same elemental chemical composition.

2. The nickel-base sintered alloy as claimed in claim 1, consisting essentially of, in weight percentage:

| | |
|---|---|
| chromium | 19.0 |
| tungsten | 15.0 |
| cobalt | 10.0 |
| molybdenum | 0.5 |
| iron | 1.5 |
| titanium | 0.4 |
| silicon | 0.5 |
| manganese | 0.5 |
| carbon | 0.4 |

and the balance nickel and incidental impurities.

3. The nickel-base sintered alloy as claimed in claim 1, consisting essentailly of, in weight percentage:

| | |
|---|---|
| chromium | 19.0 |
| tungsten | 15.0 |
| cobalt | 10.0 |
| molybdenum | 0.5 |
| iron | 1.5 |
| titanium | 0.4 |
| silicon | 0.5 |

-continued

| | |
|---|---|
| manganese | 0.5 |
| carbon | 0.4 |
| boron | 0.1 |

-continued

| | |
|---|---|
| aluminum | 0.8 |

and the balance nickel and incidental impurities.

4. The nickel-base sintered alloy as claimed in claim 1, also containing, in weight percentage, from 0.05 to 1.00% boron and from 0.1 to 2.0 aluminum.

* * * * *